US011457752B1

(12) United States Patent
Cetera

(10) Patent No.: US 11,457,752 B1
(45) Date of Patent: Oct. 4, 2022

(54) BALL CAP DISPLAY RACK

(71) Applicant: Michael W Cetera, Frisco, TX (US)

(72) Inventor: Michael W Cetera, Frisco, TX (US)

( * ) Notice: Subject to any disclaimer, the term of this patent is extended or adjusted under 35 U.S.C. 154(b) by 0 days.

(21) Appl. No.: 17/181,099

(22) Filed: Feb. 22, 2021

Related U.S. Application Data

(60) Provisional application No. 62/978,842, filed on Feb. 20, 2020.

(51) Int. Cl.
*A47F 7/06* (2006.01)
*A47F 5/08* (2006.01)

(52) U.S. Cl.
CPC ..... *A47F 7/06* (2013.01); *A47F 5/0838* (2013.01)

(58) Field of Classification Search
CPC .. A47F 7/06; A47F 5/08; A47F 5/0807; A47F 5/0838; A47G 25/10; A47C 7/64; B60R 7/08; B60R 7/10; A47B 61/04
USPC ..... 211/30–33
See application file for complete search history.

(56) References Cited

U.S. PATENT DOCUMENTS 2,937,759 A * 5/1960 Smith ..... A47G 25/10 211/32
5,240,123 A * 8/1993 Hawk ..... A47F 7/06 211/30
5,305,875 A * 4/1994 Meyer ..... B65D 5/4208 220/4.28
6,223,910 B1 * 5/2001 Levin ..... A47F 7/06 211/113
6,311,879 B1 * 11/2001 Rigler ..... A47F 7/06 211/30
D882,968 S * 5/2020 Avendano ..... D6/320

FOREIGN PATENT DOCUMENTS

WO WO-2017106927 A1 * 6/2017

* cited by examiner

*Primary Examiner* — Devin K Barnett
(74) *Attorney, Agent, or Firm* — Kenneth L. Tolar

(57) ABSTRACT

A cap rack includes a base strip having a substantially semicircular support band positioned thereon. The support band upwardly extends at a predetermined, acute angle relative to a vertical plane to restrain a ball cap in an optimal viewing angle. The support band includes a clip on each of two side portions and a button retainer on an upper portion for securing a folded cap crown. Multiple strips can be interconnected to form a rack having a larger capacity, if desired.

12 Claims, 7 Drawing Sheets

BALL CAP DISPLAY RACK

CROSS REFERENCE TO RELATED APPLICATIONS

This application claims priority of provisional application No. 62/978,842 filed on Feb. 20, 2020, the specification of which is incorporated herein by reference.

BACKGROUND OF THE INVENTION

The present invention relates to a rack that conveniently displays multiple ball caps at an optimal viewing angle in which the ornamentation is readily visible.

DESCRIPTION OF THE PRIOR ART

Collecting ball caps associated with sports teams, golf courses, businesses, and similar themes is a popular hobby. Often, the more appealing feature of a particular cap is its ornamentation, such as a logo, team insignia, or business identity. However, displaying caps with the ornamentation readily visible is challenging and difficult because the cap must be suspended at an angle, with the cap bill tilting downwardly.

Caps are often stored on shelves that contain either insufficient or excessive storage space that usually cannot be altered according to the size of a given cap collection. Additionally, when resting on a shelf, caps are horizontally oriented such that the ornamentation is partially obscured by the cap's bill. A few cap racks exist that purportedly allow a user to conveniently store multiple ball caps. However, the caps must be collapsed and nested, which conceals the ornamentation. Glass display cases can only store a single cap in a horizontal position whereby the logo is marginally visible.

Accordingly, there is currently a need for a cap rack that can adequately display a plurality of caps at an optimal viewing angle. The present invention addresses this need by providing a rack that suspends multiple caps at an angle in which the ornamentation is readily visible to those nearby.

SUMMARY OF THE INVENTION

The present invention relates to a cap rack comprising a base strip having a semicircular support band positioned thereon. The support band upwardly extends at a predetermined, acute angle relative to a vertical plane to restrain a ball cap in an optimal viewing angle. The support band includes a clip on each of two side portions and a button retainer on an upper portion for securing a folded cap crown. Multiple strips can be interconnected to form a rack having a larger capacity, if desired.

It is therefore an object of the present invention to provide a rack that conveniently displays multiple ball caps at an optimal viewing angle.

It is therefore another object of the present invention to provide a cap rack having a selectively variable storage capacity.

It is yet another object of the present invention to provide a cap rack that is easily attachable to a support surface.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
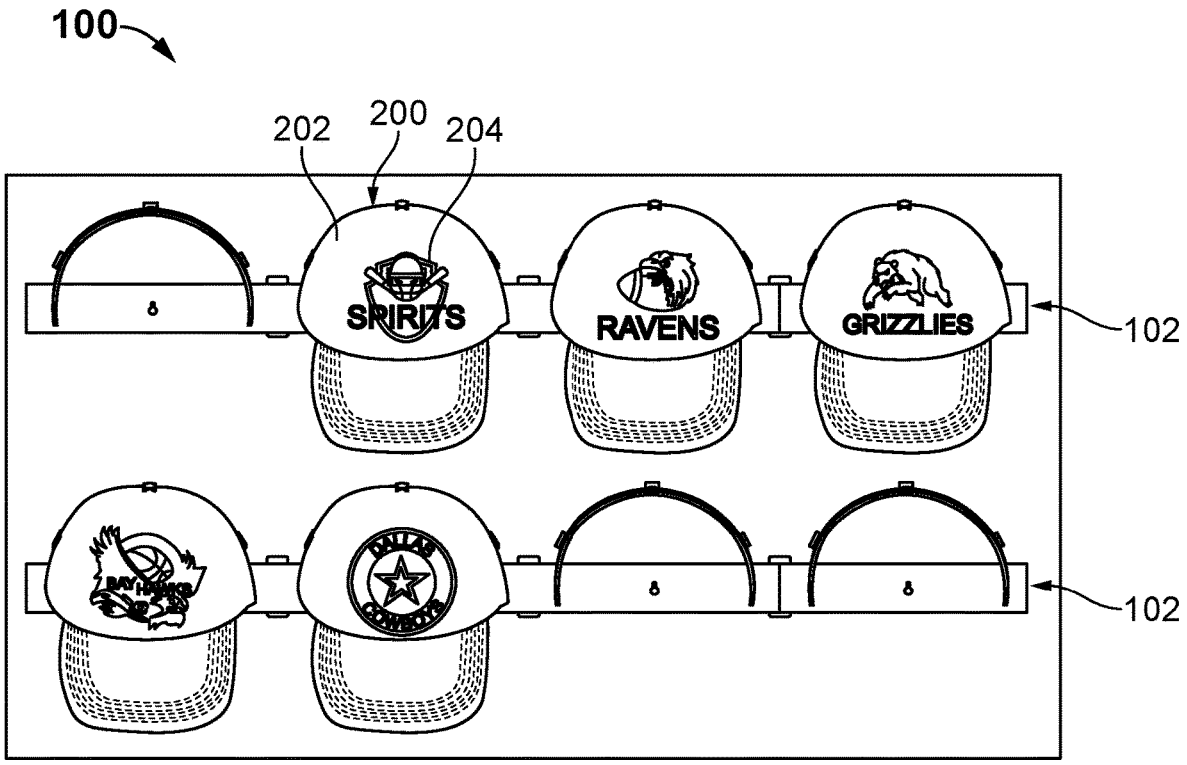
FIG. 1 depicts the ball cap rack according to the present invention.
Figure 2:
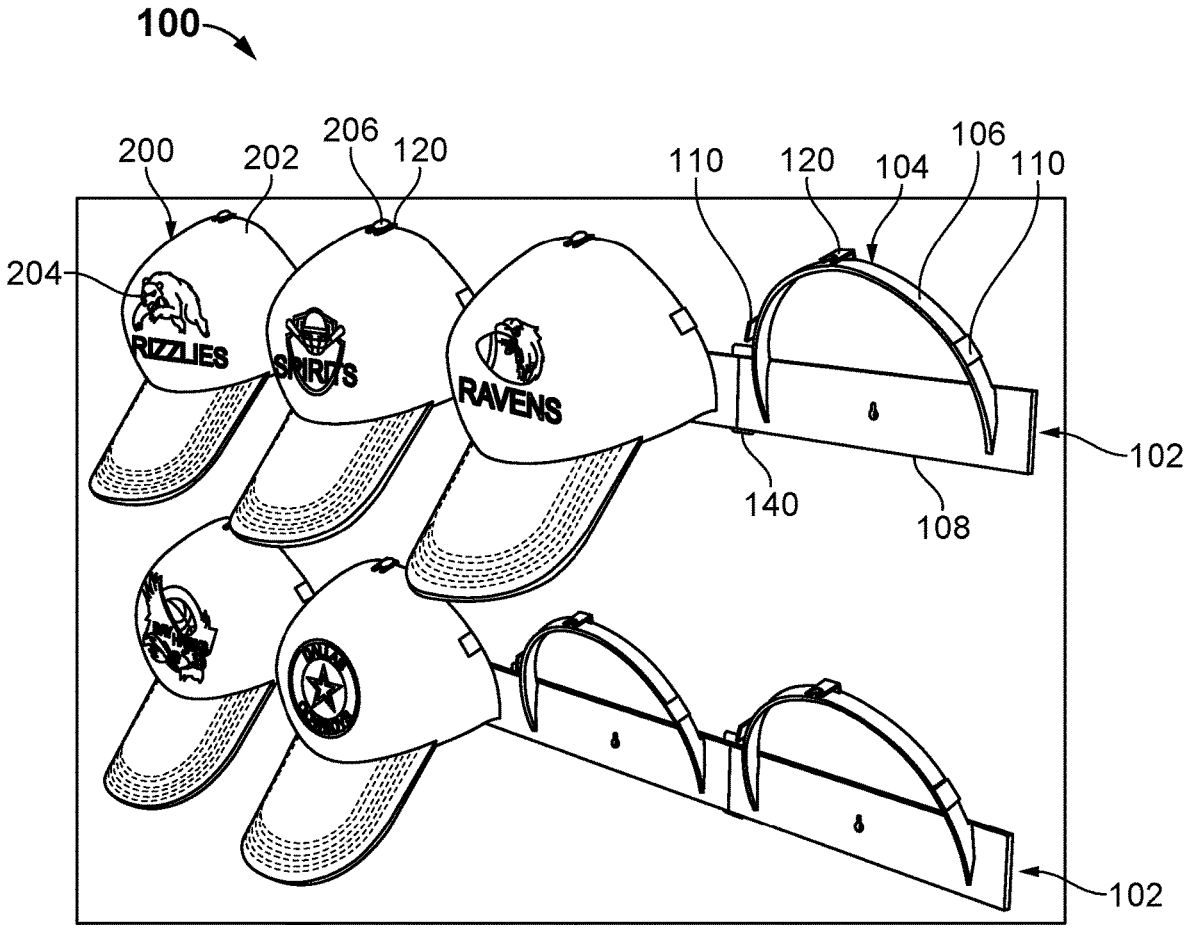
FIG. 2 is a perspective view of the ball cap rack.
Figure 3:
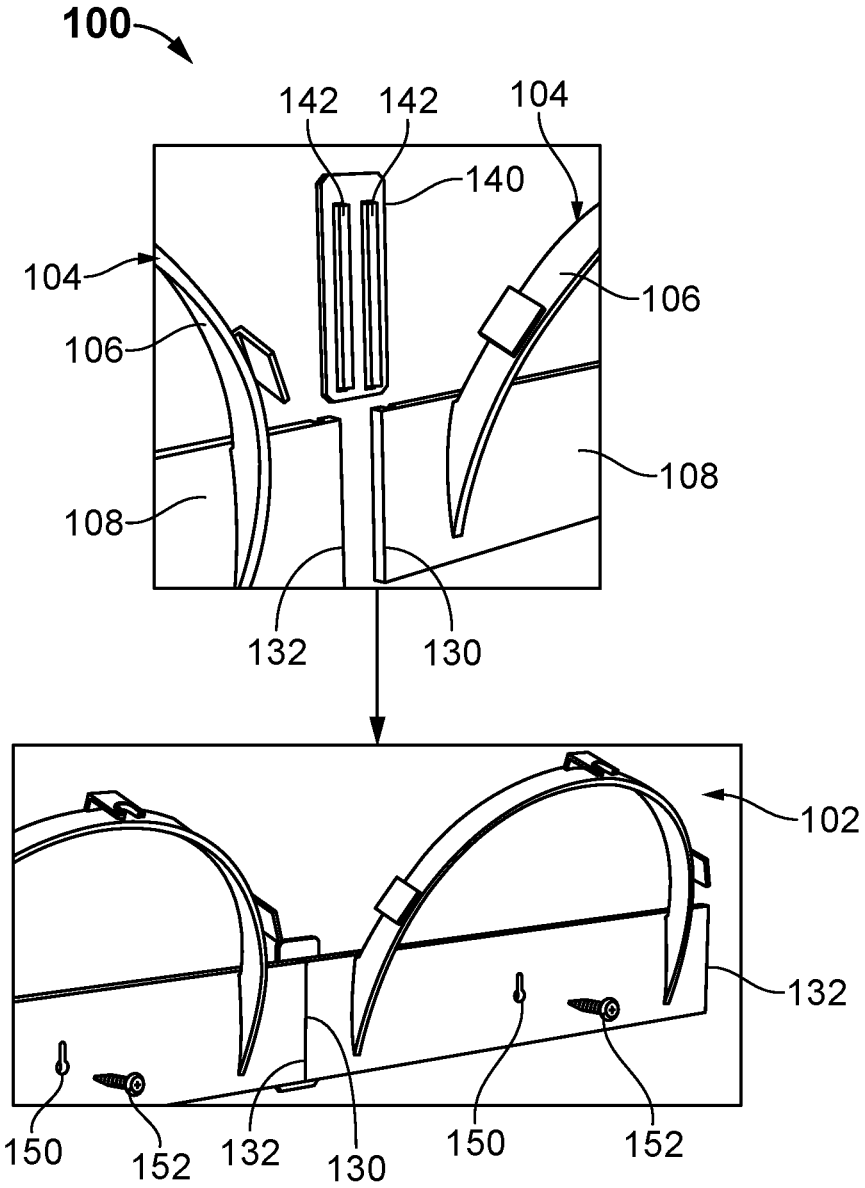
FIG. 3 depicts the means of connecting multiple base strips to form a larger rack.
Figure 4:
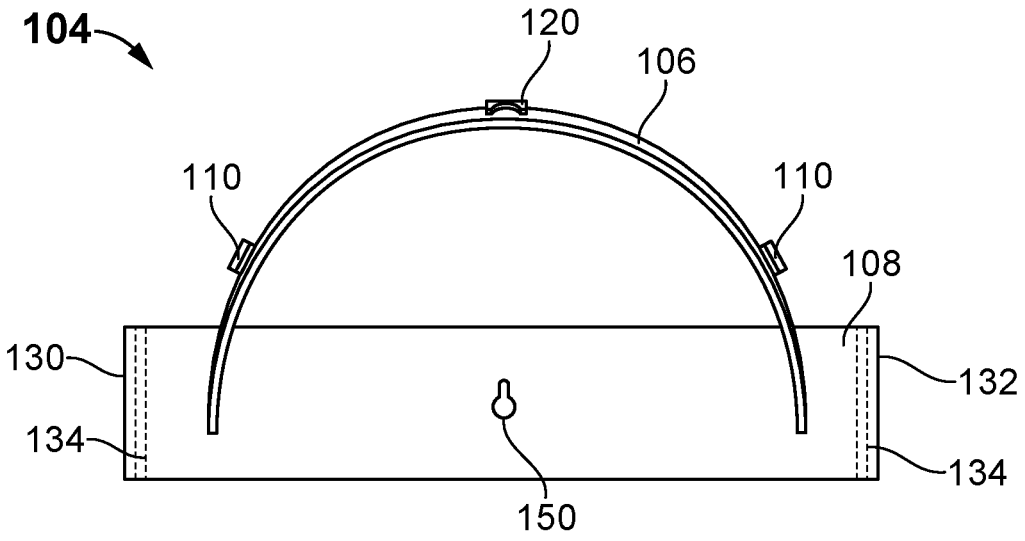
FIG. 4 is a front view of the ball cap rack.
Figure 5:
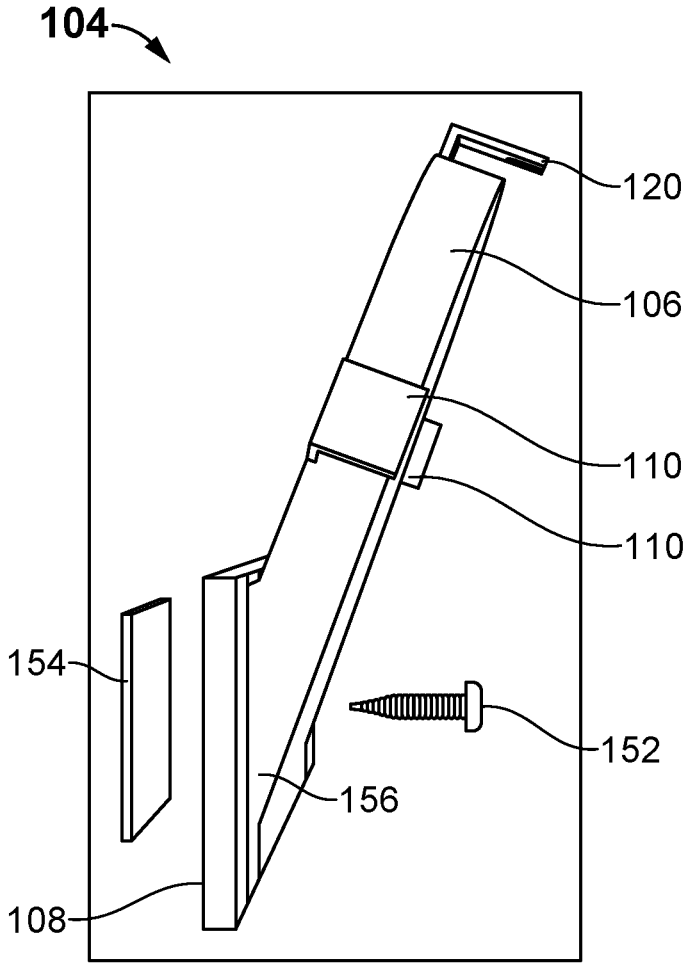
FIG. 5 is a side view of the ball cap rack.
Figure 6A:
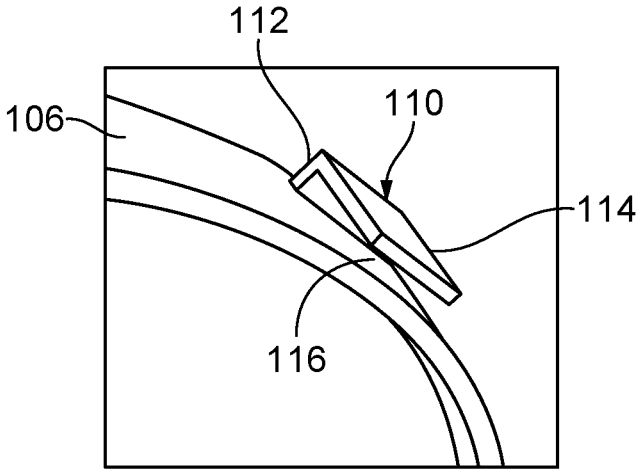
FIG. 6A is an isolated, perspective view of an exemplary clip mounted on the side portion of each support band.
Figure 6B:
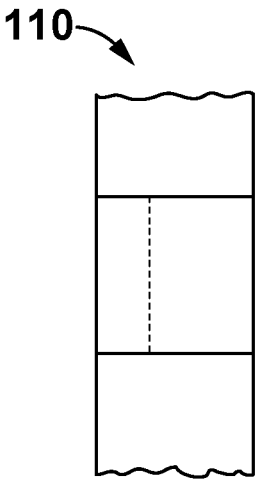
FIG. 6B is an isolated, front view of the exemplary clip.
Figure 6C:
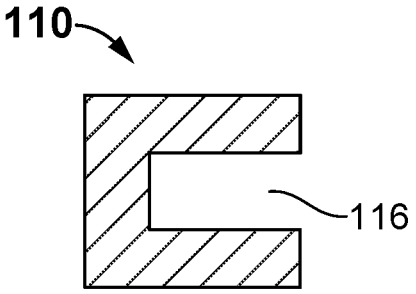
FIG. 6C is a cross-section of the clip.
Figure 7A:
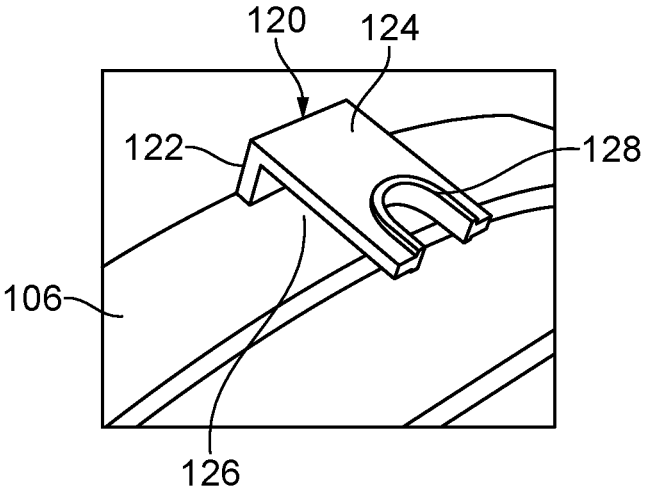
FIG. 7A is an isolated, perspective view of the button grip.
Figure 7B:
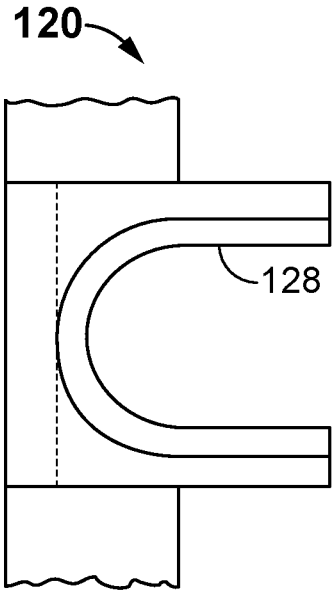
FIG. 7B is a front view of the button grip.
Figure 7C:
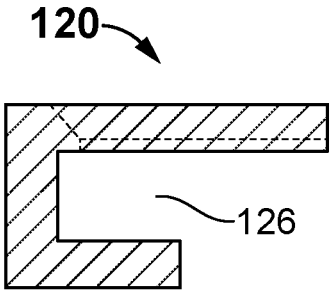
FIG. 7C is a cross-section of the button grip.
Figure 8A:
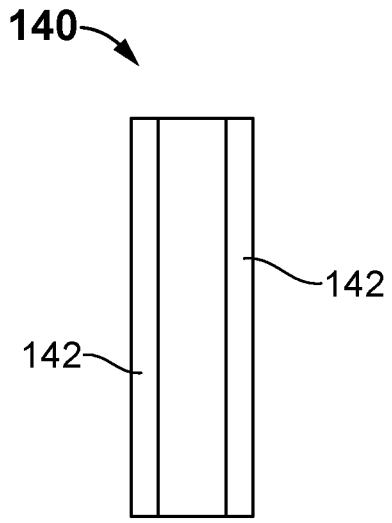
FIG. 8A is a front view of the connector.
Figure 8B:
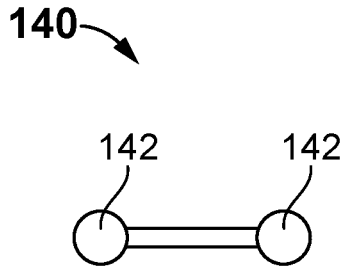
FIG. 8B is a top view of the connector.

The present invention 100 relates to a rack 102 for supporting a plurality of ball caps 200 at an angle where the cap ornamentation 204 is readily visible to those nearby. The rack 100 according to the present invention comprises a base strip 108 having a front surface, a rear surface, a first end 130, and an opposing second end 132. On the rear surface of the base strip, near each end, is a channel 134 that slidably receives a connector 140 for joining two or more strips to form a larger rack. The connector 140 includes a pair of juxtaposed, vertical protrusions 142 that are dimensioned and configured to firmly fit within the channels. On the front surface of the base strip is at least one keyed aperture 150 that receives a fastener 152 to attach the base strip to a wall or other support surface. Additionally, the base strip is further secured with multiple patches of dual-sided foam adhesive.

Integrally extending from the front surface of the base strip is a substantially semicircular support band 104 having an arcuate upper portion 106 with a pair of side portions depending therefrom. The connection between the support band and the base strip is structurally enhanced with gussets 156 to prevent fracturing or severing during use. The support band upwardly extends at a predetermined acute angle relative to a vertical plane to restrain a ball cap in an optimal viewing orientation. The support band includes a clip 110 on each of the two side portions and a button grip 120 on the upper portion. The clip 110 is formed of an L-shaped tab having a back section 112 with an elongated flap 114 perpendicularly extending therefrom. A space 116 formed between the flap 114 and support band is dimensioned to firmly receive a folded cap crown 202 as explained in more detail below.

The button grip is also L-shaped and includes a rear wall 122 with a fork 124 perpendicularly extending from an upper end. The fork includes a pair of spaced times that form a slot 128 for slidably receiving a cap button 206. A space 126 formed between the fork and support band receives a folded portion of a cap crown 202 as described in more detail below. The thickness of each tine tapers toward its distal end to easily slip beneath a cap button while creating sufficient friction to secure the cap to the support band.

The support band 106 could include a goose-neck LED lamp attached to its rear surface, near the button grip 120. The LED lamp could extend outwardly and over the crown to illuminate the ornamentation 204.

To store caps on the rack according to the present invention, a user secures one or more base strips to a wall or other support surface. The rear section of the cap crown is folded inwardly into a front section. The resulting fold line is inserted into the clips and the grip tines are slid beneath the cap button. The upwardly angled support bands position the cap in a downward angle wherein the ornamentation is readily visible.

The above-described device is not limited to the exact details of construction and enumeration of parts provided herein. Preferably, the support band, the clips and button grip are integrally molded as a unitary component to eliminate the need for additional fasteners and to prevent inadvertent misplacement of the various elements. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A cap storage rack comprising:

a first base strip having a front surface, a rear surface, a first end, and an opposing second end;

a substantially semicircular support band positioned on the front surface of said first base strip wherein a connection between the support band and the first base strip is structurally enhanced with a gusset, said support band having an arcuate upper portion with a pair of side portions depending therefrom, said support band upwardly extending at a predetermined acute angle relative to a vertical plane of the first base strip to restrain a ball cap in a discrete viewing orientation;

a clip on each of said side portions of said support band for securing a folded edge of the ball cap;

a button grip on the arcuate upper portion of said support band for sliding beneath a cap button of the ball cap.

2. The cap storage rack according to claim 1 further comprising:

a second base strip having a first end and an opposing second end;

a first channel on the rear surface of said first base strip, near the first end of said first base strip;

a second channel on the rear surface of said second base strip, near the second end of said second base strip;

a connector having a pair of juxtaposed, vertical protrusions, a first of said pair of juxtaposed, vertical protrusions slidably received within the first channel and a second of said pair of juxtaposed, vertical protrusions slidably received within the second channel to connect said first base strip to said second base strip.

3. The cap storage rack according to claim 1 further comprising:

at least one keyed aperture on the front surface of said first base strip;

at least one fastener received within said at least one keyed aperture and secured to a support surface.

4. The cap storage rack according to claim 1 wherein each clip comprises an L-shaped tab having a back section with an elongated flap perpendicularly extending therefrom.

5. The cap storage rack according to claim 1 wherein said button grip is L-shaped and includes a rear wall with a fork perpendicularly extending from an upper end, said fork including a pair of spaced tines that form a slot for slidably receiving the cap button of the ball cap.

6. The cap storage rack according to claim 5 wherein a thickness of each of said tines tapers toward a distal end to facilitate sliding beneath the cap button of the ball cap while creating friction between the button grip and the cap button of the ball cap.

7. A cap storage rack comprising:

a first base strip having a front surface, a rear surface, a first end, and an opposing second end;

a substantially semicircular support band positioned on the front surface of said first base strip, said support band having an arcuate upper portion with a pair of side portions depending therefrom, said support band upwardly extending at a predetermined acute angle relative to a vertical plane of the first base strip to restrain a ball cap in a discrete viewing orientation;

a clip on each of said side portions of said support band for securing a folded edge of the ball cap;

a button grip on the arcuate upper portion of said support band for sliding beneath a cap button of the ball cap;

a second base strip having a first end and an opposing second end;

a first channel on the rear surface of said first base strip, near the first end of said first base strip;

a second channel on the rear surface of said second base strip, near the second end of said second base strip;

a connector having a pair of juxtaposed, vertical protrusions, a first of said pair of juxtaposed, vertical protrusions slidably received within the first channel and a second of said pair of juxtaposed, vertical protrusions slidably received within the second channel to connect said first base strip to said second base strip.

8. The cap storage rack according to claim 7 wherein a connection between the support band and the base strip is structurally enhanced with a gusset.

9. The cap storage rack according to claim 7 further comprising:

at least one keyed aperture on the front surface of said first base strip;

at least one fastener received within said at least one keyed aperture and secured to a support surface.

10. The cap storage rack according to claim 7 wherein each clip comprises an L-shaped tab having a back section with an elongated flap perpendicularly extending therefrom.

11. The cap storage rack according to claim 7 wherein said button grip is L-shaped and includes a rear wall with a fork perpendicularly extending from an upper end, said fork including a pair of spaced tines that form a slot for slidably receiving the cap button of the ball cap.

12. The cap storage rack according to claim 11 wherein a thickness of each of said tines tapers toward a distal end to facilitate sliding beneath the cap button of the ball cap while creating friction between the button grip and the cap button of the ball cap.

* * * * *